US010575611B2

(12) United States Patent
Dingler et al.

(10) Patent No.: US 10,575,611 B2
(45) Date of Patent: Mar. 3, 2020

(54) MULTI-ACCESS POCKET

(71) Applicant: ACCO Brands Corporation, Lake Zurich, IL (US)

(72) Inventors: Noah Dingler, Phoenixville, PA (US); Andrew Miller, Phoenixville, PA (US); Patrick Nolan, Royersford, PA (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 16/000,364

(22) Filed: Jun. 5, 2018

(65) Prior Publication Data

US 2018/0343995 A1 Dec. 6, 2018

Related U.S. Application Data

(60) Provisional application No. 62/515,238, filed on Jun. 5, 2017.

(51) Int. Cl.

| | |
|---|---|
| ***A45C 3/00*** | (2006.01) |
| ***A45C 13/00*** | (2006.01) |
| ***A45F 3/04*** | (2006.01) |
| ***A45F 3/02*** | (2006.01) |
| ***A45C 13/10*** | (2006.01) |
| ***A45C 7/00*** | (2006.01) |
| *A45F 3/00* | (2006.01) |

(52) U.S. Cl.

CPC ..... *A45C 3/00* (2013.01); *A45C 7/0027* (2013.01); *A45C 7/0068* (2013.01); *A45C 13/00* (2013.01); *A45C 13/103* (2013.01); *A45F 3/02* (2013.01); *A45F 3/04* (2013.01); *A45C 2200/20* (2013.01); *A45F 2003/003* (2013.01); *A45F 2200/0566* (2013.01); *A45F 2200/0583* (2013.01)

(58) Field of Classification Search

CPC ..... A45C 2003/005; A45C 2003/007; A45C 7/00; A45C 7/0068; A45C 7/0072

See application file for complete search history.

(56) References Cited

U.S. PATENT DOCUMENTS

| | | | | | |
|---|---|---|---|---|---|
| 3,708,045 | A * | 1/1973 | Katz | A45C 3/00 | 190/113 |
| 4,334,601 | A * | 6/1982 | Davis | A45C 3/00 | 190/111 |
| 4,513,866 | A * | 4/1985 | Thomas | A45C 9/00 | 190/110 |
| 4,773,515 | A * | 9/1988 | Kotkins, Jr. | A45C 7/0068 | 190/103 |
| 4,805,748 | A * | 2/1989 | Gerch | A45C 3/00 | 150/163 |

(Continued)

*Primary Examiner* — Brian D Nash

(74) *Attorney, Agent, or Firm* — Fitch, Even, Tabin & Flannery LLP

(57) ABSTRACT

A storage device including a storage device body configured to store items therein, and a pocket. The pocket includes a piece of pocket material coupled to the body and at least partially defining a pocket cavity. The pocket further includes a first fastener configured to releasably attach the piece of pocket material to the body, and a second fastener configured to releasably attach the piece of pocket material to the body. The first fastener, when uncoupled, allows access to the pocket cavity via a first direction, and the second fastener, when uncoupled, allows access to the pocket cavity via a second direction that is different from the first direction.

17 Claims, 5 Drawing Sheets

(56) References Cited

U.S. PATENT DOCUMENTS 4,805,749 A * 2/1989 Gerch ..... A45C 3/00 150/112
4,830,154 A * 5/1989 Gerch ..... A45C 3/00 190/103
5,307,908 A * 5/1994 Shyr ..... A45C 7/0068 190/103
5,704,529 A * 1/1998 Santoro ..... A45F 3/04 224/242
5,797,529 A * 8/1998 Lavine ..... A45C 7/0077 190/103
5,873,504 A * 2/1999 Farmer ..... A45C 3/00 150/113
5,964,384 A * 10/1999 Young ..... A45C 7/0063 190/103
6,053,382 A * 4/2000 Wyant ..... A45C 7/0068 190/103
6,092,661 A * 7/2000 Mogil ..... A63B 55/408 150/106
6,227,339 B1 5/2001 Bogert
6,247,328 B1 * 6/2001 Mogil ..... A45C 7/0077 383/110
6,558,062 B1 5/2003 Wyant et al.
6,601,743 B2 8/2003 Godshaw
7,077,596 B1 7/2006 Bianco et al.
7,665,421 B2 * 2/2010 Martz ..... A01K 1/0254 119/497
7,908,675 B2 3/2011 Robinson
8,033,747 B2 10/2011 Busam et al.
8,157,140 B2 4/2012 Jay
8,522,939 B2 9/2013 Rowe
8,978,850 B2 * 3/2015 Bettua ..... A45C 7/0068 190/103
9,078,504 B2 * 7/2015 Crandall ..... A45C 7/0063
9,119,448 B1 * 9/2015 Hirshberg ..... A45C 7/0077
2002/0139820 A1 10/2002 Godshaw et al.
2003/0024960 A1 * 2/2003 Greenstein ..... A45C 11/20 224/153
2005/0077135 A1 4/2005 Drew et al.
2009/0032418 A1 * 2/2009 Hamilton ..... A45C 11/00 206/315.9
2010/0108731 A1 * 5/2010 Rowe ..... A45F 3/042 224/654
2012/0223088 A1 9/2012 Bedard
2013/0182976 A1 7/2013 Ashley
2016/0157588 A1 6/2016 Ford
2016/0206061 A1 7/2016 Ford

* cited by examiner

MULTI-ACCESS POCKET

This application claims priority to U.S. Provisional Patent Application Ser. No. 62/515,238, entitled MULTI-ACCESS POCKET and filed on Jun. 5, 2017, the entire contents of which are hereby incorporated by reference.

The present disclosure is directed to a pocket for storing items, and more particularly, to a pocket which can be accessed along at least two different directions.

BACKGROUND

Storage bags or devices, such as backpacks, duffle bags and the like, are commonly used to store loose items, such as school and office products, exercise and gym equipment, clothing, travel items, etc. The storage bags may include one or more pockets on an outer surface thereof to store loose items. However, many existing pockets provide access from only a single side, edge or direction.

SUMMARY

The present disclosure is directed to a pocket that can provide access from various sides, edges or directions. More particularly, in one embodiment the disclosure is directed to a storage device including a storage device body configured to store items therein, and a pocket. The pocket includes a piece of pocket material coupled to the body and at least partially defining a pocket cavity. The pocket further includes a first fastener configured to releasably attach the piece of pocket material to the body, and a second fastener configured to releasably attach the piece of pocket material to the body. The first fastener, when uncoupled, allows access to the pocket cavity via a first direction, and the second fastener, when uncoupled, allows access to the pocket cavity via a second direction that is different from the first direction.

DETAILED DESCRIPTION

Figure 1:
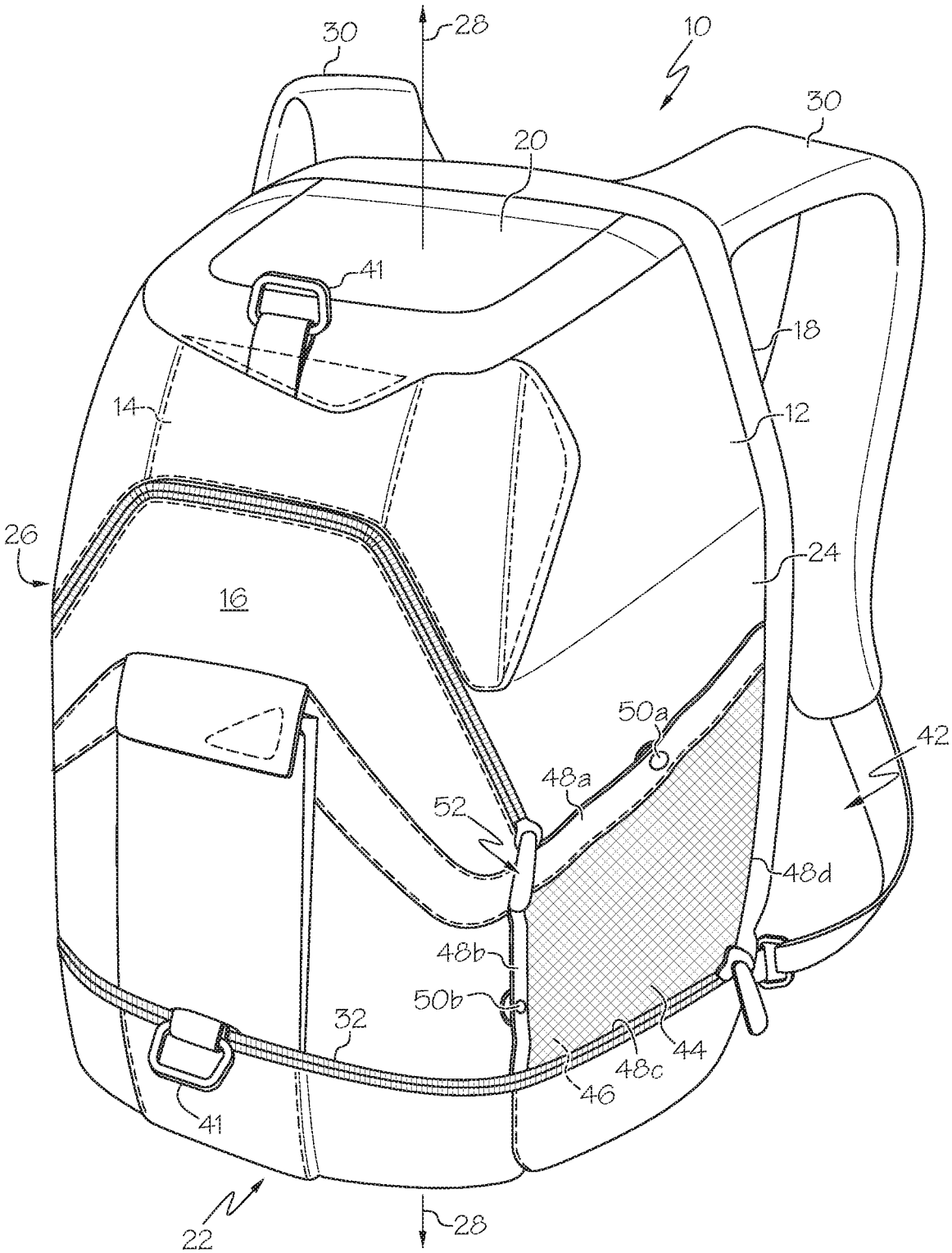
FIG. 1 is a front perspective view of one embodiment of the storage bag of the present invention, shown in a vertical configuration and with a bottom area in a collapsed state.

As shown in FIGS. 1-5, the storage bag or device 10 disclosed herein can include a body, outer casing or substrate 12 defining an inner volume, inner cavity or storage device cavity 14 for storing various items therein. The inner cavity 14 can be generally closed and configured to store items therein, and can be further sub-divided into various compartments and cavities by walls, dividers, etc. positioned in the inner cavity 14 (not shown). When the storage bag 10 is in its configuration and state shown in FIG. 1, the storage bag 10 can include a front panel or surface 16 and an and opposed back panel or surface 18, a top panel or surface 20 and opposed bottom panel or surface 22, and two opposed side panels or surfaces 24, 26 such that the storage bag 10 and inner cavity 14 are each shaped as a generally rectangular prism shape in one case. The storage bag 10 can have a central/longitudinal axis 28 extending along its greatest dimension/length (e.g. between the top panel 20 and bottom panel 22 in the illustrated embodiment). FIG. 1 illustrates the storage bag 10 in a first or collapsed state wherein the storage bag 10/outer casing 12 is relatively collapsed and the inner cavity 14 has a relatively small storage capacity. FIG. 1 also illustrates the storage bag 10 in a first configuration or orientation (e.g. a vertical/upright and/or backpack configuration).

A pair of backpack straps 30 can be coupled to the outer casing 12. Each backpack strap 30 can be configured to fit about a shoulder of a wearer such that the storage bag 10 can be carried as a backpack when in the first configuration, with the axis 28 oriented vertically. Each backpack strap 30 can be coupled to the back panel/surface 18 at or adjacent to the top panel 20 and one end thereof and the bottom panel 22 at the other end, and can extend generally parallel to the central/longitudinal axis 28 thereof. It should be noted that while the illustrated embodiments show the storage bag 10 having two backpack straps 30, only a single backpack strap 30 can be utilized and the storage bag 10 can be used and carried as a so-called "sling" bag.

In one embodiment the storage bag 10 includes a zipper or other releasable fastener 32 that extends entirely along the front panel 16, and along both sides panels 24, 26, positioned at or adjacent to the bottom panel 22. The zipper 32 releasably secures together those portions of the front panel 16 and side panels 24, 26 on one side of the zipper 32, and the remaining portions on the other side of the zipper 32, so that the storage bag 10/outer casing 12 and/or inner cavity 14 can be moved to an expanded state wherein the inner cavity 14 has a relatively large storage capacity. More particularly, in order to move the storage bag 10 from the collapsed state to the extended state, the releasable fastener 32 can be uncoupled, thereby allowing the bottom panel 22 to pivot, about the junction between the bottom panel 22 and the back panel 18, to a position where the bottom panel 22 is generally parallel with the back panel 18, as shown in FIG. 2.

When the bottom panel 22 is so positioned, an expansion portion 34 of generally flexible material positioned in the inner cavity 14, such as a bag-like piece of flexible or mesh material in one case, positioned in the cavity 14 can be pulled through the opening 36 formed by the pivoting of the bottom panel 22. When deployed, the expansion material 34 may extend beyond the position that the bottom panel 22 is located when the storage bag 10 is in its first/collapsed state, thereby providing the inner cavity 14 with increased volume/storage capacity. The expansion material 34 includes solid end piece 31 in the illustrated embodiment, which provides a supplemental bottom panel 22' to the bag 10 when the expansion material 34 is deployed. In the illustrated embodiment, the expansion portion 34 includes a releasable fasteners, such as a zipper 33 that can be operated to access the inner cavity portion 14 of the expansion material 34. Of course, the manner in which the opening 36 is formed, to accommodate the expansion material 34, can be varied from that shown, including for example having the zipper 32 extend around three sides of the perimeter of the bottom panel 22, having the zipper 32 entirely positioned in the bottom panel 22 to define a flap therein, etc.

Figure 2:
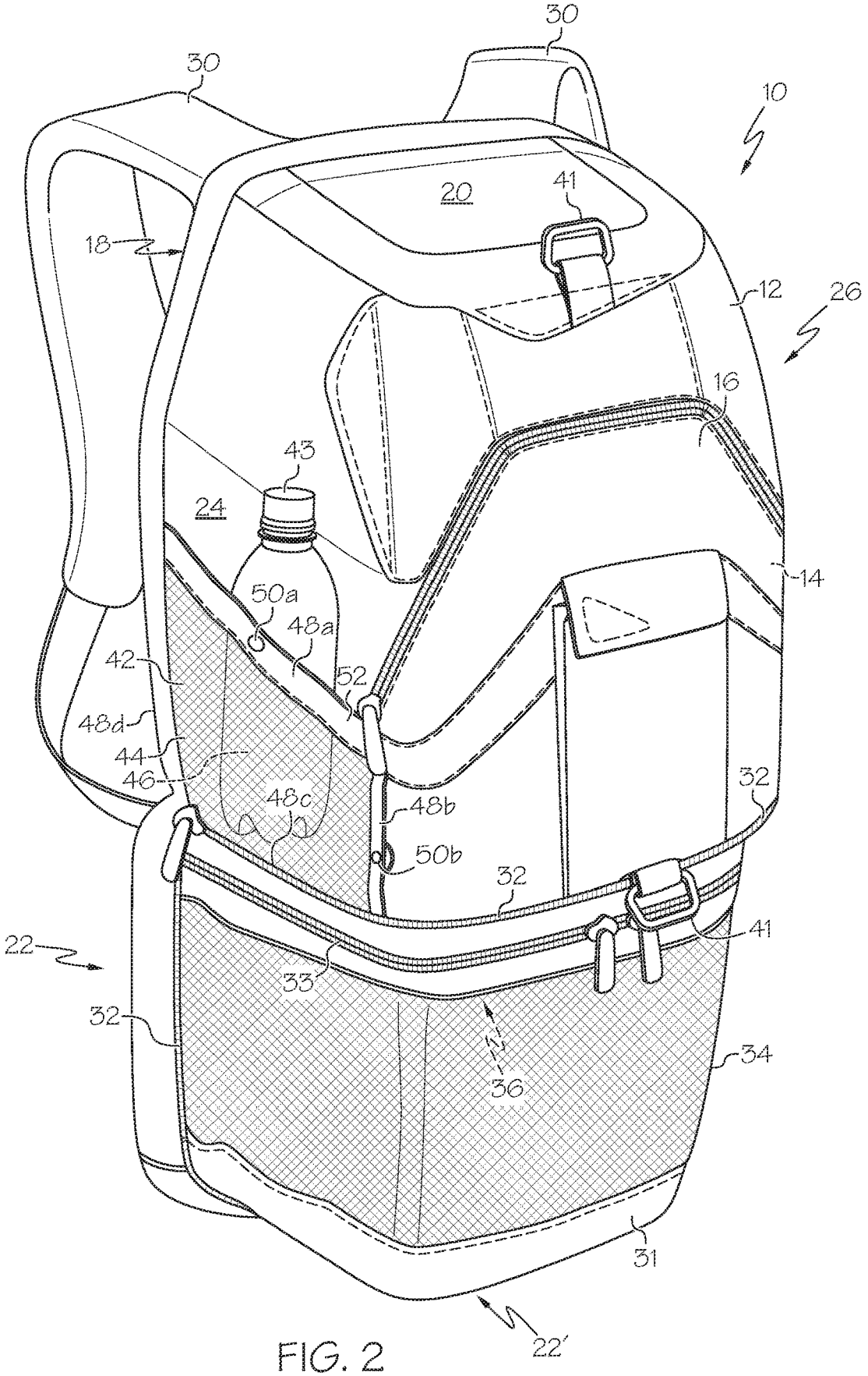
FIG. 2 is a front perspective view of the storage bag of FIG. 1, with the bottom area of the storage bag in expanded state, and with a water bottle inserted into the pocket in a first configuration.
Figure 3:
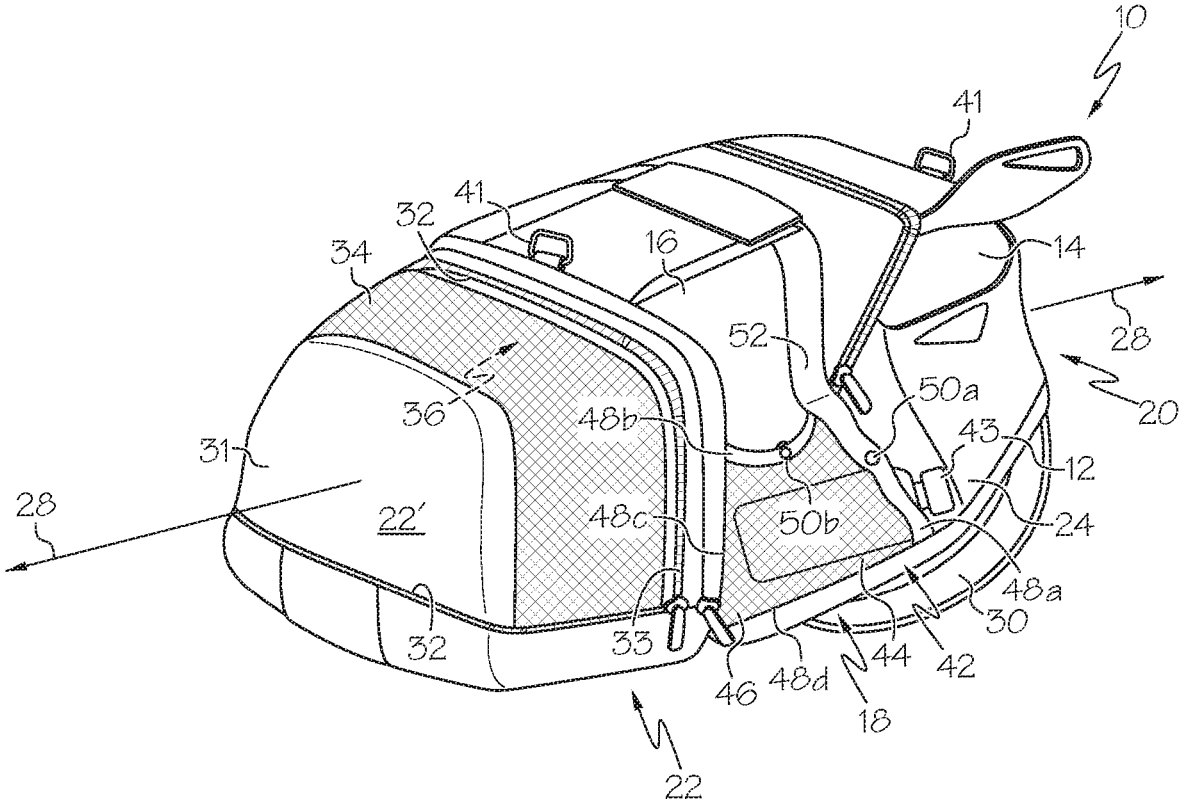
FIG. 3 is a front perspective view of the storage bag of FIG. 2, shown in a horizontal configuration.
Figure 4:
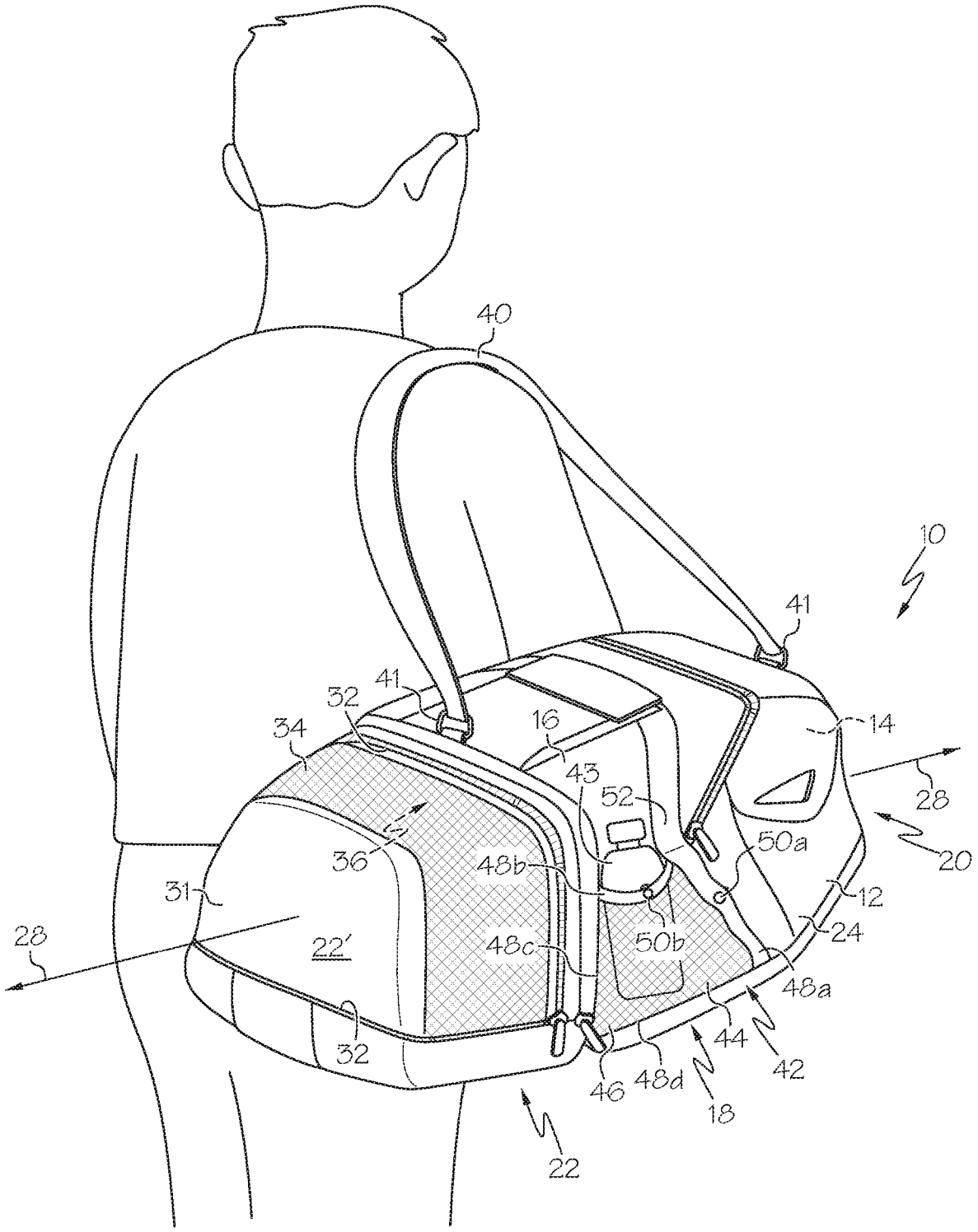
FIG. 4 is a front perspective view of the storage bag of FIG. 3, with a different strap configuration and with the water bottle in a different orientation.
Figure 5:
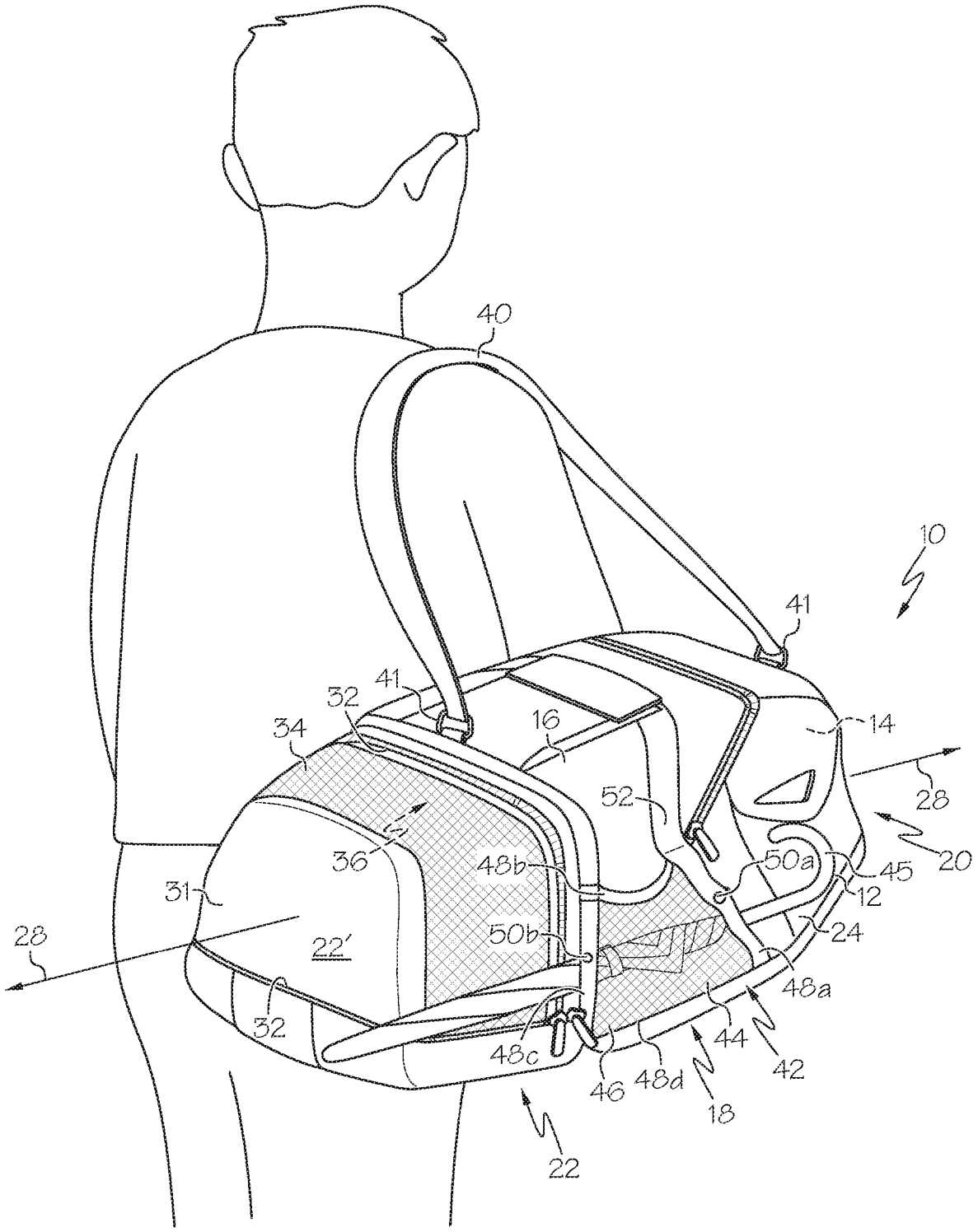
FIG. 5 is a front perspective view of the storage bag of FIG. 4, with a differing pocket configuration and with an umbrella inserted into the pocket.

After the storage bag 10 is moved to its second/expanded state, as shown in FIG. 2, the storage bag 10 can be moved to its second configuration or orientation (e.g. a horizontally-oriented and/or duffle bag configuration) as shown in FIGS. 3-5 (although it should be understood that the storage bag 10 can be used in the second configuration or orientation even without moving the storage bag 10 to its second/expanded state). In this case, a shoulder strap 40 (FIGS. 4 and 5) can be connected to a pair of loops 41 on the front surface 16 of the storage bag 10. When deployed, the shoulder strap 40 can extend generally parallel to the axis 28 and the shoulder strap 40 can be configured to fit over the shoulder of a wearer while the storage bag 10 is positioned in the second, generally horizontal configuration as shown in FIGS. 4 and 5. If desired, the backpack straps 30 can remain in place when the storage bag 10 is in the second configuration (as shown in FIG. 3), or alternatively the backpack straps 30 can be folded flat and/or secured in place against the back surface 18, or further alternatively the backpack straps 30 can be removed (FIGS. 4 and 5). Further alternatively, the shoulder strap 40 can be folded flat and/or secured in place against the outer casing 14, when not in use. Both the backpack straps 30 and/or the shoulder strap 40 can be permanently attached to the outer casing 14 at both ends, or removably attached at both ends, or permanently attached at one end and removably attached at the other end.

It should be understood that while one particular embodiment of the storage bag 10/inner cavity 14 is movable from a relatively low storage capacity state to a relatively high storage capacity state, the storage capacity of the inner cavity 14 is not be required to be adjusted in all cases, and instead the storage bag 10 can retain the same storage capacity when used in both the first and second configurations, or the storage bag 10 may not have a variable capacity. The storage bag or device 10 also need not necessarily be designed to be used in two different orientations. Moreover, if the storage bag 10/inner cavity 14 is configured to have varying size/volume, the capacity of the storage bag 10/inner cavity 14 may be able to be adjusted by any of a wide variety of manners, methods and configurations other than those shown and described herein. For example, in one case a releasable fastener, such as a zipper or the like, can extend around the entire perimeter of the outer casing 12, and the released end of the outer casing 12 can be moved away in the direction of axis 28 once released to provide expansion capabilities to the storage bag 10/inner cavity 14.

The storage bag can include an outer pocket 42 formed by a piece of pocket material 44 positioned on an outer surface of the outer casing 12 to define a pocket cavity 46 therebetween. The piece of pocket material 44 can be made from a variety of materials, but in one case is made of a stretchable/elastic mesh material that is relatively flat and lacks any pleats, etc. The pocket cavity 46 can in one case be a continuous cavity although if desired the pocket cavity 46 can be divided into various compartments, with various dividers, stitching, or the like positioned in the pocket cavity 46. The piece of pocket material 44 can be a single-ply piece of material and form the pocket cavity 46 directly with the outer casing 12, and the outer pocket 42 thus may lack any inner pocket piece of material, and lack any side gussets.

In the illustrated embodiment, the pocket 42/piece of pocket material 44 is shaped as an irregular four-sided polygon having four sides or edges 48*a*, 48*b*, 48*c*, 48*d*, although the shape and configuration of the pocket 42/pocket material 44 can vary as desired. In one case each edge 48*a*, 48*b*, 48*c*, 48*d* is a straight or generally straight edge that differs in direction from an adjacent edge by at least about 45 degrees in one case, or at least about 60 degrees in another case. In the illustrated embodiment the pocket material 44 is securely/permanently coupled to the outer casing 12 along two edges 48*c*, 48*d* thereof, such as by stitching, welding, adhesives, etc., or other means which are not manually tearable or separable. The pocket 42/pocket material 44 thus has two free edges 48*a*, 48*b* which are not permanently secured to the outer casing 12, but at least part or all of the two free edges 48*a*, 48*b* can be releasable secured to the outer casing 12 by associated releasable fasteners 50. If desired, the piece of pocket material 44 can also be secured to the outer casing 12 at a corner 52 between the two free edges 48*a*, 48*b* (or any other free edges which are releasably secured). Each free edge 48*a*, 48*b* can be uncoupled along at least about 90% of its length in one case, or at least about 75% or its length in another case, to provide access to the pocket cavity 46.

In the illustrated embodiment the pocket 42 includes a first releasable fastener 50*a*, in the form of a pair of cooperating releasable snap components, one of which is permanently coupled to the pocket material 44, and the other of which is permanently coupled to the outer casing 12. The first releasable fastener 50*a* is positioned along or adjacent to the first free edge 48*a*, and a second releasable fastener 50*b*, illustrated in the form of a cooperating releasable snap component, is positioned along or adjacent to the second free edge 48*b*. The releasable fasteners 50*a*, 50*b* can be separate, distinct independent fasteners 50 that are spaced apart from each other, and can take any of a wide variety of configurations beyond the snaps shown and described herein, such as clasps, ties, magnetic fasteners, zippers, hook-and-loop fastening material, slide fasteners, inter-engaging geometries, etc.

In one embodiment, the releasable fasteners 50*a*, 50*b* are independently operable and spaced away from one another such that, for example, each of the releasable fasteners 50*a* 50*b* can be opened while the other is closed, and vice versa, or both can be closed at the same time or both can be open at the same time. Each releasable fastener 50*a*, 50*b* can at least partially be positioned on the piece of pocket material 44 but relatively close to the associated edge 48*a*, 48*b*; for example, in one case the entirety of each releasable fastener 50*a*, 50*b* is not spaced away from the associated edge 48*a*, 48*b*, in a direction perpendicular to the associated edge 48*a*, 48*b*, by a distance that is more than 10% in one case, or 20% in another case, of a length of the associated edge 48*a*, 48*b*.

The illustrated fasteners 50*a*, 50*b* take the form of snap components that provide a relatively localized connection. For example, the fasteners 50*a*, 50*b* may extend less than 25% in one case, or less than 10% in another case, along the length of an associated edge 48. Each localized fastener 50*a*, 50*b* can be centered along a length of the associated edge 48*a*, 48*b*. The localized fasteners 50*a*, 50*b* can provide a relatively strong, quick and easy-to-operate mechanism for opening and/or closing, and increased breathability to, the pocket 42 as compared to, for example, zippers or hook-and-loop fasteners. Localized fasteners also provide some unattached areas along the free edges which can allow relatively slim items, such as writing instruments, rulers, etc. to be easily inserted into, and retracted from, the pocket 42 without operating the fasteners 50*a*, 50*b*, or even be located in a configuration where a distal end of the inserted item protrudes out of the pocket 42, while larger items can still be secured in the pocket 42. However it should be understood that other more linear fasteners (such as zippers, elongated hook-and-loop-fastening material, slide fasteners, etc.) can be utilized, that extend entirely (or generally entirely) or partially along an edge 48*a*, 48*b*, or further alternatively a string of linear fasteners extending along an edge 48*a*, 48*b* can be utilized.

This arrangement of the pocket 42 provides significant utility by itself or for use of the storage bag 10 in its two different configurations. In particular, when the storage bag 10 is in its first configuration as shown in FIG. 1, the edge 48*b* of the pocket 42, which is vertically oriented, can be closed/secured by its releasable fastener 50*b*, while the other two edges 48*c*, 48*d* are permanently secured. The edge 48*a* of the pocket 42, which extends generally horizontally, can be opened/accessed by a user by manually disconnecting the releasable fastener 50*a*, thereby providing access to the pocket cavity 46 from an upper/vertical direction (with respect to a gravitational frame of reference) to insert an item (such as a water bottle 43) into the pocket 42, as shown in FIG. 2. The inserted item 43 is then securely held in place along the three other edges 48*b*, 48*c*, 48*d* and/or by frictional forces. Thus the pocket 42 can allow access to the pocket 42 from a vertical direction, and allow items to be stored and retained therein, regardless of the orientation of the storage bag 10.

When the inserted item is larger than the pocket 42 such that the item protrudes beyond the edge 48*a*, the edge 48*a* can remain in its unsecured state, but the item remains in place due to engagement with the piece of pocket material 44 and/or due to gravitational forces. Relatively small items (e.g. having a size about equal to or smaller than the piece of pocket material 44) can be entirely retained in the pocket 42, by placing the item in the pocket cavity 46 and securing all fasteners 50*a*, 50*b* around the perimeter of the pocket 42. In some cases the piece of pocket material 44 can be an elastic material so that the capacity of the pocket 42 can expand somewhat to accommodate items that are larger than the initial volume of the pocket cavity 46.

When the storage bag 10 is in its second configuration as shown in FIGS. 3-5, the edge 48*a* is now in a generally vertical configuration, while the edge 48*b* is in a generally horizontal configuration. In this case, then, the fastener 50*a* of the edge 48*a* can be closed/secured, while the fastener 50*b* of the edge 48*b* can be opened/disconnected to allow access to the pocket cavity 46 from the upper/vertical direction. The water bottle 43 can then be reoriented in the vertical direction, as can be seen in comparing FIGS. 3 and 4. Thus, the pocket 42 is configured such that it can provide access from a particular (vertical) direction, and also secure containment of items positioned therein, when the storage bag 10 is in either of its two configurations. In addition the pocket 42 enables an item to be inserted into the pocket cavity 46 from first direction (through a first edge 48*a* or 48*b*), and removed from the pocket cavity 46 in a second direction (through a second edge 48*a* or 48*b*).

Various different ones of the edges 48*a*, 48*b*, 48*c*, 48*d* can be permanently or releasably attached. In particular, instead of the two adjacent edges 48*a*, 48*b* being releasably coupled, two opposite edges (e.g. edges 48*a* and 48*c*, or 48*b* and 48*d*) can be releasably attached to the outer casing 12, while the other two edges are permanently coupled. For example, in the embodiment of FIG. 5, a fastener 50*a* is located along edge 48*a*, while another fastener 50*b* is located along edge 48*c*, opposite and parallel to edge 48*a*, while one or both of the other edges 48*b*, 48*d*, are secured, unsecured, or securable with fasteners. This configuration may be useful when the pocket 42 is mounted on or coupled to an item that is usable in two 180 degree opposite configurations, and/or when a relatively linear-oriented item such as an umbrella 45, baseball bat, or other longitudinally oriented is desired to be inserted through two opposite edges 48. Thus using this configuration such a longitudinally oriented device can always be configured/oriented as desired (e.g. vertically or horizontally in one case). Alternatively, any three of the edges (48*a*, 48*b*, 48*c*, 48*d*), or if desired all edges 48*a*, 48*b*, 48*c*, 48*d* can be releasably coupled to enable the pocket cavity 46 to be accessed from a variety of directions/orientations.

The piece of pocket material 44 can be permanently secured to the outer casing at the corners, or other areas/spacing away from the free edges, such as by stitching, welding, adhesives, etc. that cannot be manually released or unsecured and/or that cannot be released or unsecured without damaging the outer casing 12 or piece of pocket material 44. Alternatively, the corners or areas away from the free edges can be semi-permanently secured—e.g. coupled to the outer casing 12 but disconnectable with greater force or effort than that required to release the releasable fasteners 50. For example the semi-permanent connection can take the form of snap connections that require a higher force to disconnect than the snap connections 50*a*, 50*b*, or take the form of a threaded fastener, etc. In this case, each of the corner connections and/or non-free edges can be semi-permanently coupled to the outer casing 12 so that the piece of pocket material 44 can be entirely removed from the storage bag 10 and replaced, repositioned, etc.

It should be further understood that while the piece of pocket material 44 is disclosed as a four-sided piece of material with edges 48*a*, 48*b*, 48*c*, 48*d* that are generally perpendicular, the piece of pocket material 44 can have various other shapes, including hexagons, circles, triangles, irregular shapes, etc. In this case, although the pocket 42 may not have two generally perpendicular edges, fasteners 50 can be positioned at various locations along the piece of pocket material 44, and the pocket 42 can be configured to provide access to the pocket cavity 46 from two different or generally perpendicular directions, or other directions as desired. For example, in one case the piece of pocket material 44 can be a seven-sided piece of material positioned on a top surface of a binder or other school or office product, with four permanent attachment points, three semi-permanent attachment points, and seven open edges 48, each with a releasable closure device 50. This particular arrangement can provide access to the pocket cavity 46 from various different directions. In one case all, some, or at least two of the edges 48 are neither parallel nor perpendicular to each other. This helps to ensure any tearing or removal forces applied to an edge of the piece of pocket material 44 (e.g. when a particularly wide component is forced into the pocket cavity 46) are not as directly applied to adjacent edges, and can improve the strength and durability of the pocket 42.

Thus, the disclosed pocket arrangement provides a pocket 42 that can be accessed from multiple directions and orientations, yet can still securely retain the contents of the pocket 42 in place.

It should be further understood that while the pocket 42 is shown used in conjunction with a storage bag 10, the pocket 42 can be used in any of a wide variety of products or items, such as product or items for storing items and/or for school, home or office use, such as messenger bags or storage bags, binders, pockets, pouches, backpacks, duffle bags, folders, portfolios, backpacks, tech device/storage sleeves, notebooks, etc. These products or items may be able to be used and/or carried in only one, or in other cases, more than one orientation. In one case the storage bag 10 or other item on which the pocket is used is not an article of clothing configured to relatively closely fit about a wearer's body, such as a pair of pants or trousers, or a shirt, coat, jacket, skirt, vest, etc.

Having described the invention in detail and by reference to the various embodiments, it should be understood that modifications and variations thereof are possible without departing from the scope of the claims of the present application.

What is claimed is:

1. A storage device comprising:

a storage device body configured to store items therein; and a pocket including:

a piece of pocket material having at least four outer edges coupled to the body and at least partially defining a pocket cavity between said piece of pocket material and said body;

a first fastener configured to releasably attach the piece of pocket material to the body; and a second fastener configured to releasably attach the piece of pocket material to the body, wherein the first fastener, when uncoupled, allows access to the pocket cavity in a first direction, and the second fastener, when uncoupled, allows access to the pocket cavity in a second direction that is different from the first direction, wherein each fastener is positioned along or adjacent to differing ones of the edges of the piece of pocket material, and wherein at least two remaining edges of the piece of pocket material are permanently coupled to the body.

2. The storage device of claim 1 wherein the first fastener and the second fastener are distinct and independently operable.

3. The storage device of claim 1 wherein the first direction is coplanar with but generally perpendicular to the second direction.

4. The storage device of claim 1 wherein the first direction is coplanar with but generally opposite to the second direction.

5. The storage device of claim 1 wherein the storage device body includes a storage device cavity that is discrete and spaced away from the pocket cavity, and configured to store items therein.

6. The storage device of claim 1 wherein the storage device body is a messenger bag or a storage bag or a binder or a pocket or a backpack or a duffle bag or a folder or a portfolio or a pouch or a storage sleeve or a notebook, and wherein the storage device body is not an article of clothing.

7. The storage device of claim 1 wherein the storage device is configured to be used in a first orientation where the first direction is a generally vertical direction, and wherein the storage device is also configured to be used in a second orientation where the second direction is a generally horizontal direction.

8. The storage device of claim 1 wherein each fastener extends less than 25% along the length of an associated edge.

9. The storage device of claim 1 wherein the body is configured to be moved between a collapsed state wherein the body has a relatively low storage capacity, and an expanded state wherein the body has a relatively high storage capacity, and wherein the storage device includes a fastening system to releasably retain the body in at least one of the collapsed or expanded states.

10. The storage device of claim 1 wherein the body has a longitudinal axis and wherein the storage device further comprises at least one backpack strap attachable to the body and configured such that the body can be worn over the shoulder of a wearer via the at least one backpack strap in an orientation wherein the longitudinal axis is oriented generally vertically, and wherein the storage device further comprises at least one shoulder strap attachable to the body and configured such that the body can be worn over the shoulder of a wearer via the shoulder strap in an orientation wherein the longitudinal axis is oriented generally horizontally.

11. The storage device of claim 1 wherein the first fastener is operable to secure the piece of pocket material to the body when the second fastener does not secure the piece of pocket material to the body, wherein the second fastener is operable to secure the piece of pocket material to the body when the first fastener does not secure the piece of pocket material to the body, and wherein the first and second fasteners are operable to both simultaneously secure the piece of pocket material to the body, and wherein the first and second fasteners are operable to both simultaneously not secure the piece of pocket material to the body.

12. The storage device of claim 1 wherein the first fastener, when releasably attaching the piece of pocket material to the body, generally blocks access to the pocket cavity in the first direction, and the second fastener, when releasably attaching the piece of pocket material to the body, generally blocks access to the pocket cavity in the second direction.

13. The storage device of claim 1 wherein the piece of pocket material is generally flat and planar, and oriented in a plane generally parallel to a plane of a portion of the body to which the piece of pocket material is attached.

14. The storage device of claim 1 wherein the first fastener, when uncoupled, allows access to the pocket cavity in the first direction oriented generally parallel to a plane of the piece of pocket material.

15. The storage device of claim 1 wherein the first and second directions are both coplanar with a plane of the piece of pocket material.

16. A storage device system comprising:

a storage device configured to be used in a first orientation and a second orientation;

a piece of planar pocket material coupled to the storage device and at least partially defining a pocket cavity positioned between said piece of planar pocket material and said storage device in a direction perpendicular to a plane of said piece of planar pocket material, wherein said piece of planar pocket material is coupled to an outer surface of said storage device such that an outer surface of said piece of planar pocket material is positioned outside of said pocket cavity along said perpendicular direction;

a first fastener configured to releasably attach the piece of planar pocket material to the storage device; and a second fastener configured to releasably attach the piece of planar pocket material to the storage device, wherein the first fastener, when uncoupled, allows access to the pocket cavity in a generally vertical direction when the storage device is in the first orientation, and the second fastener, when uncoupled, allows access to the pocket cavity in the vertical direction when the storage device is in the second orientation.

17. The storage device system of claim 16 wherein the storage device has a longitudinal axis and wherein the system further comprises at least one backpack strap attachable to the storage device and configured such that the storage device can be worn over the shoulder of a wearer via the at least one backpack strap in an orientation wherein the longitudinal axis is oriented generally vertically, and wherein the system further comprises at least one shoulder strap attachable to the storage device and configured such that the storage device can be worn over the shoulder of a wearer via the shoulder strap in an orientation wherein the longitudinal axis is oriented generally horizontally.

* * * * *